US008838001B2

(12) United States Patent
Ishida

(10) Patent No.: US 8,838,001 B2
(45) Date of Patent: Sep. 16, 2014

(54) FIXING DEVICE INCLUDING A TUBULAR MEMBER AND LEAF SPRING WHICH URGES INNER PERIPHERAL SURFACE OF TUBULAR MEMBER IN RADIAL DIRECTION

(75) Inventor: Kei Ishida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 255 days.

(21) Appl. No.: 13/334,183

(22) Filed: Dec. 22, 2011

(65) Prior Publication Data

US 2012/0163885 A1 Jun. 28, 2012

(30) Foreign Application Priority Data

Dec. 24, 2010 (JP) ..... 2010-287371

(51) Int. Cl.
*G03G 15/20* (2006.01)

(52) U.S. Cl.
USPC ..... 399/329

(58) Field of Classification Search
USPC ..... 399/329
See application file for complete search history.

(56) References Cited

U.S. PATENT DOCUMENTS

| | | | |
|---|---|---|---|
| 4,187,033 | A | 2/1980 | Zukowski |
| 6,456,818 | B1 | 9/2002 | Nakayama et al. |
| 6,501,935 | B2 | 12/2002 | Hirai et al. |
| 6,830,212 | B1 | 12/2004 | Harris |
| 7,242,895 | B2 | 7/2007 | Inada et al. |
| 7,283,780 | B2 | 10/2007 | Uchida et al. |
| 7,359,666 | B2 * | 4/2008 | Takashi et al. ..... 399/329 |
| 7,593,678 | B2 | 9/2009 | Suenaga |
| 7,664,448 | B2 | 2/2010 | Lee et al. |
| 7,881,650 | B2 | 2/2011 | Shin et al. |
| 7,965,970 | B2 | 6/2011 | Haseba et al. |
| 8,032,069 | B2 | 10/2011 | Shin et al. |
| 8,131,197 | B2 | 3/2012 | Hiraoka et al. |
| 2001/0022909 | A1 | 9/2001 | Takeuchi et al. |
| 2002/0018676 | A1 | 2/2002 | Hirai et al. |
| 2002/0039504 | A1 | 4/2002 | Nakayama et al. |

(Continued)

FOREIGN PATENT DOCUMENTS

| | | | |
|---|---|---|---|
| CN | 101261481 | A | 9/2008 |
| CN | 101846944 | A | 9/2010 |

(Continued)

OTHER PUBLICATIONS

Machine translation of JP06-118823.*

(Continued)

*Primary Examiner* — David Bolduc
(74) *Attorney, Agent, or Firm* — Banner & Witcoff, Ltd.

(57) ABSTRACT

A fixing device includes: a flexible tubular member, a nip member, a backup member, and a leaf spring member. The flexible tubular member is circularly movable in a moving direction and has an inner peripheral surface. The nip member is disposed so as to be in sliding contact with the inner surface of the tubular member. The backup member is configured to provide a nip region in cooperation with the nip member upon nipping the tubular member between the backup member and the nip member. The leaf spring member is disposed so as to be in sliding contact with the inner peripheral surface of the tubular member and is configured to urge the inner peripheral surface of the tubular member outward in a radial direction of the tubular member.

8 Claims, 4 Drawing Sheets

(56) References Cited

U.S. PATENT DOCUMENTS

| | | | | |
|---|---|---|---|---|
| 2003/0185604 | A1 | 10/2003 | Sato | |
| 2005/0185994 | A1 | 8/2005 | Inada et al. | |
| 2005/0191097 | A1* | 9/2005 | Yoshida et al. | 399/329 |
| 2007/0059001 | A1* | 3/2007 | Matsuura et al. | 399/45 |
| 2007/0059022 | A1* | 3/2007 | Yamaoka et al. | 399/92 |
| 2007/0212135 | A1 | 9/2007 | Suenaga | |
| 2008/0112739 | A1 | 5/2008 | Shinshi | |
| 2008/0124147 | A1* | 5/2008 | Uehara et al. | 399/329 |
| 2008/0219723 | A1 | 9/2008 | Lee et al. | |
| 2008/0292374 | A1 | 11/2008 | Hiraoka et al. | |
| 2009/0047047 | A1 | 2/2009 | Ardery et al. | |
| 2009/0080954 | A1 | 3/2009 | Miyata et al. | |
| 2009/0092423 | A1 | 4/2009 | Shin et al. | |
| 2009/0208264 | A1 | 8/2009 | Fujiwara et al. | |
| 2010/0202809 | A1* | 8/2010 | Shinshi et al. | 399/329 |
| 2010/0247183 | A1 | 9/2010 | Haseba et al. | |
| 2011/0091254 | A1 | 4/2011 | Shin et al. | |
| 2011/0129267 | A1* | 6/2011 | Arimoto et al. | 399/329 |
| 2011/0170917 | A1 | 7/2011 | Yoshikawa et al. | |
| 2012/0093548 | A1* | 4/2012 | Kimura | 399/329 |

FOREIGN PATENT DOCUMENTS

| | | | |
|---|---|---|---|
| JP | H04-122969 | A | 4/1992 |
| JP | 05-341685 | A | 12/1993 |
| JP | 06-118823 | A | 4/1994 |
| JP | 06-282183 | | 10/1994 |
| JP | 08-248791 | | 9/1996 |
| JP | 10-268681 | A | 10/1998 |
| JP | 10-340017 | | 12/1998 |
| JP | 2000-330417 | | 11/2000 |
| JP | 2002-123107 | A | 4/2002 |
| JP | 2003-316181 | | 11/2003 |
| JP | 2004-198556 | A | 7/2004 |
| JP | 2005-010201 | | 1/2005 |
| JP | 2005-234294 | A | 9/2005 |
| JP | 2007-017772 | | 1/2007 |
| JP | 2007-279665 | A | 10/2007 |
| JP | 2008-224878 | A | 9/2008 |
| JP | 2008-233886 | | 10/2008 |
| JP | 2008-292793 | A | 12/2008 |
| JP | 2009-093141 | A | 4/2009 |
| JP | 2009-237089 | | 10/2009 |

OTHER PUBLICATIONS

Extended EP Search Report mailed May 3, 2012, EP Appln. 11192796.8-2216.
Non-final Office Action received in U.S. Appl. No. 13/334,165 mailed Sep. 4, 2013.
Final Office Action issued in U.S. Appl. No. 13/334,157 mailed Oct. 22, 2013.
JP Office Action mailed Jan. 22, 2013, JP Appln. 2010-288620, English Translation.
JP Office Action mailed Jan. 15, 2013, JP Appln. 2010-287935, English Translation.
JP Office Action mailed Jan. 15, 2013, JP Appln. 2010-287377, English Translation.
JP Office Action mailed Jan. 15, 2013, JP Appln. 2010-287371, English Translation.
Non-final Office Action received in U.S. Appl. No. 13/334,157 mailed May 15, 2013.
Co-pending U.S. Appl. No. 13/334,170, filed Dec. 22, 2011.
Co-pending U.S. Appl. No. 13/334,157, filed Dec. 22, 2011.
Co-pending U.S. Appl. No. 13/334,165, filed Dec. 22, 2011.
Non-final Office Action received in U.S. Appl. No. 13/334,170 mailed Jul. 11, 2013.
English Translation JP2004-198556 dated Jul. 11, 2013.
Notice of Allowance issued in corresponding U.S. Appl. No. 13/334,165, mailed Jan. 30, 2014.
CN First Office Action mailed Jan. 21, 2014, CN appln. 201110441042.5, English Translation.
Notice of Allowance issued in corresponding U.S. Appl. No. 13/344,157 mailed Feb. 28, 2014.
Final Office Action received in U.S. Appl. No. 13/334,170 mailed Apr. 9, 2014.
CN First Office Action mailed Jul. 14, 2014, CN appln. 201110441042.5, English Translation.

* cited by examiner

FIXING DEVICE INCLUDING A TUBULAR MEMBER AND LEAF SPRING WHICH URGES INNER PERIPHERAL SURFACE OF TUBULAR MEMBER IN RADIAL DIRECTION

CROSS REFERENCE TO RELATED APPLICATION

This application claims priority from Japanese Patent Application No. 2010-287371 filed Dec. 24, 2010. The entire content of the priority application is incorporated herein by reference.

TECHNICAL FIELD

The present invention relates to a fixing device that thermally fixes a transferred developing agent image to a sheet.

BACKGROUND

A conventional thermal fixing device for an electro-photographic type image forming device includes a tubular film, a heater disposed in an internal space of the film, a pressure roller providing a nip region in conjunction with the film, and a flange located an inner side of the film for guiding rotation of the film.

In the conventional thermal fixing device, the flange is provided with a film sliding portion including a movable wall that is movable in a radial direction of the film. The movable wall includes an outer surface that has a circular arc shape. The outer surface of the movable wall is in surface contact with an inner peripheral surface of the tubular member. The movable wall is urged by a spring to provide a tensile force to the film. Hence, a slack of the film can be prevented.

SUMMARY

However, in such a conventional fixing device, the spring does not directory provide the tensile force on the film (a flexible tubular member) and provides the tensile force to the tubular member via the movable wall. Hence, the urging force of the spring cannot be transmitted to the tubular member with accuracy, and thus, the tensile force cannot be applied to the tubular member with stability. Further, since the flange includes the movable wall and the spring, the number of parts is increased and a structure of the fixing device is complicated. Therefore, cost for the fixing device is increased and assemblability of the fixing device is lowered. Further, the movable wall is in surface contact with an inner peripheral surface of the tubular member. Therefore, a contact surface between the movable wall and the tubular member is increased, and thus, rotational torque of the tubular member is increased.

In view of the foregoing, it is an object of the present invention to provide a fixing device capable of providing a tensile force to the tubular member with accuracy and preventing the number of parts and the contact surface from increasing.

In order to attain the above and other objects, the present invention provides a fixing device including: a flexible tubular member, a nip member, a backup member, and a leaf spring member. The flexible tubular member is circularly movable in a moving direction and has an inner peripheral surface. The nip member is disposed so as to be in sliding contact with the inner surface of the tubular member. The backup member is configured to provide a nip region in cooperation with the nip member upon nipping the tubular member between the backup member and the nip member. The leaf spring member is disposed so as to be in sliding contact with the inner peripheral surface of the tubular member and is configured to urge the inner peripheral surface of the tubular member outward in a radial direction of the tubular member.

DETAILED DESCRIPTION

Figure 1:
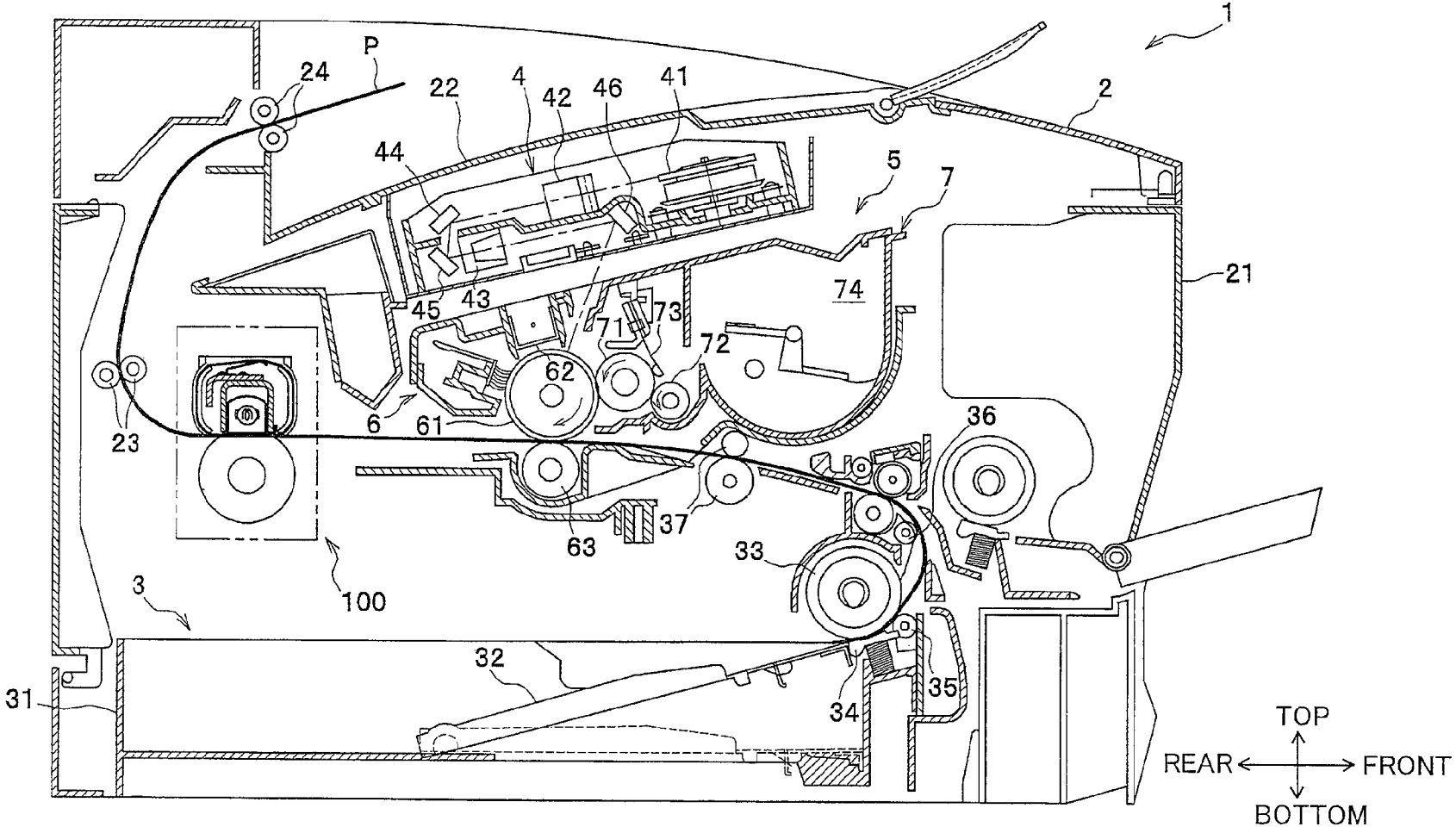
FIG. 1 is a schematic cross-sectional view showing a structure of a laser printer having a fixing device according to one embodiment of the present invention.

Next, a general structure of a laser printer as an image forming device according to one embodiment of the present invention will be described with reference to FIG. 1. The laser printer 1 shown in FIG. 1 is provided with a fixing device 100 according to the embodiment of the present invention. A detailed structure of the fixing device 100 and parts and components around thereof will be described later while referring to FIGS. 2 to 4.

<General Structure of Laser Printer>

As shown in FIG. 1, the laser printer 1 includes a main frame 2 with a movable front cover 21. Within the main frame 2, a sheet supply unit 3 for supplying a sheet P as a recording sheet, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a right side, a left side, a near side and a far side are to be referred to as a front side, a rear side, a left side and a right side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a rotatably driven polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
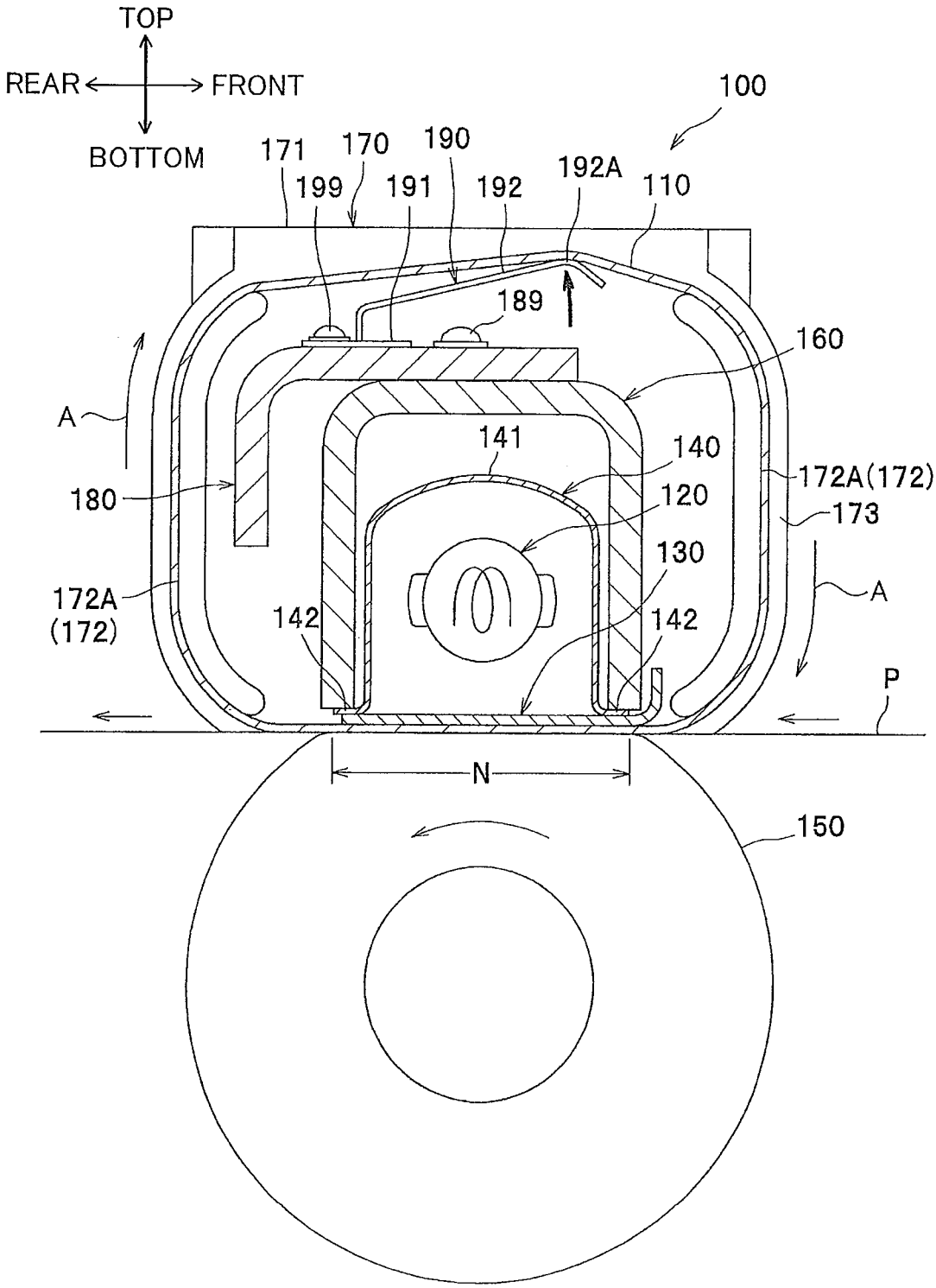
FIG. 2 is a schematic cross-sectional view showing a structure of the fixing device according to the embodiment.

As shown in FIG. 2, the fixing device 100 includes a fusing film 110 as a tubular member, a halogen lamp 120, a nip plate 130 as a nip member, a reflection plate 140, a pressure roller 150 as a backup member, a stay 160, a pair of guide members 170 (only one guide member 170 is shown), an attaching member 180, and a pair of leaf spring members 190.

The fusing film 110 is of a tubular configuration having heat resistivity and flexibility. The fusing film 110 is disposed so as to cover the halogen lamp 120, the nip plate 130, the reflection plate 140, the stay 160, the attaching member 180, and the leaf spring members 190. Each widthwise end portion of the fusing film 110 is guided by a guide surface 172A of the guide member 170 (described later) fixed to a main frame of the fixing device 100 so that the fusing film 110 is circularly movable in a circular movement direction indicated by arrows A shown in FIG. 2.

The halogen lamp 120 is a heater to heat the nip plate 130 and the fusing film 110 (a nip region N) for heating toner on the sheet P by generating radiant heat. The halogen lamp 120 is positioned at an internal space of the fusing film 110 and is spaced away from an inner peripheral surface of the fusing film 110 as well as from an inner surface of the nip plate 130 at a predetermined distance.

The nip plate 130 is adapted for receiving pressure from the pressure roller 150 and for receiving radiant heat from the halogen lamp 120. The nip plate 130 is positioned such that the inner peripheral surface of the fusing film 110 is in sliding contact with the nip plate 130. The nip plate 130 transmits radiant heat from the halogen lamp 120 to the toner on the sheet P through the fusing film 110. The nip plate 130 is made from a material such as aluminum having a thermal conductivity higher than that of the stay 160 (described later) made of steel. More specifically, the nip plate 130 is formed by bending an aluminum plate and transmits radiant heat from the halogen lamp 120 to the toner on the sheet P through the fusing film 110.

The lubricant agent (not shown) such as fluorine grease is interposed between the nip plate 130 and the fusing film 110. Thus, since a sliding resistance between the nip plate 130 and the fusing film 110 is lowered, the fusing film 110 can be rotated smoothly.

The nip plate 130 has an inner (upper) surface painted with a black color or provided with a heat absorbing member so as to efficiently absorb radiant heat from the halogen lamp 120.

The reflection plate 140 is adapted to reflect radiant heat from the halogen lamp 120 radiating in the frontward/rearward direction and an upper direction toward the nip plate 130. As shown in FIG. 2, the reflection plate 140 is positioned within the internal space of the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending outward from each end portion of the reflection portion 141 in the frontward/rearward direction. A mirror surface finishing is available on the surface of the aluminum reflection plate 140 for specular reflection in order to enhance heat reflection ratio.

As shown in FIG. 2, the pressure roller 150 is positioned below the nip plate 130. The pressure roller 150 is made from a resiliently deformable material. The pressure roller 150 is resiliently deformed to nip the fusing film 110 in cooperation with the nip plate 130 to provide the nip region N for nipping the sheet P between the pressure roller 150 and the fusing film 110. In other words, the pressure roller 150 presses the nip plate 130 through the fusing film 110 for providing the nip region N between the pressure roller 150 and the fusing film 110. In order to provide the nip region N, one of the pressure roller 150 and the nip plate 130 can be urged against remaining one of the pressure roller 150 and the nip plate 130 by an urging member such as a spring.

The pressure roller 150 is rotationally driven by a drive source (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region N between the pressure roller 150 and the fusing film 110.

The stay 160 is adapted to support end portions of the nip plate 130 through the flange portion 142 of the reflection plate 140, thereby receiving a load from the pressure roller 150. Since the nip plate 130 urges the pressure roller 150, the load is a reaction force with respect to a force with which the nip plate 130 urges the pressure roller 150.

The stay 160 has a U-shape configuration in conformity with the outer shape of the reflection portion 141 covering the reflection plate 140. More specifically, the stay 160 has an inner surface confronting the halogen lamp 120 via the reflection plate 140 and an outer surface surrounded by the fusing film 110. The stay 160 is made by bending a steel plate into U-shape, thereby having a relatively high rigidity.

As a result of assembly of the nip plate 130 together with the reflection plate 140 and the stay 160, the flange portions 142 are pinched between the nip plate 130 and the stay 160. As a result, displacement of the reflection plate 140 in a rightward/leftward direction (widthwise direction) due to vibration caused by operation of the fixing device 100 can be restrained. Further, since the stay 160 having high rigidity supports the flange portions 142 of the reflection plate 140, rigidity of the reflection plate 140 can be ensured.

Figure 3:
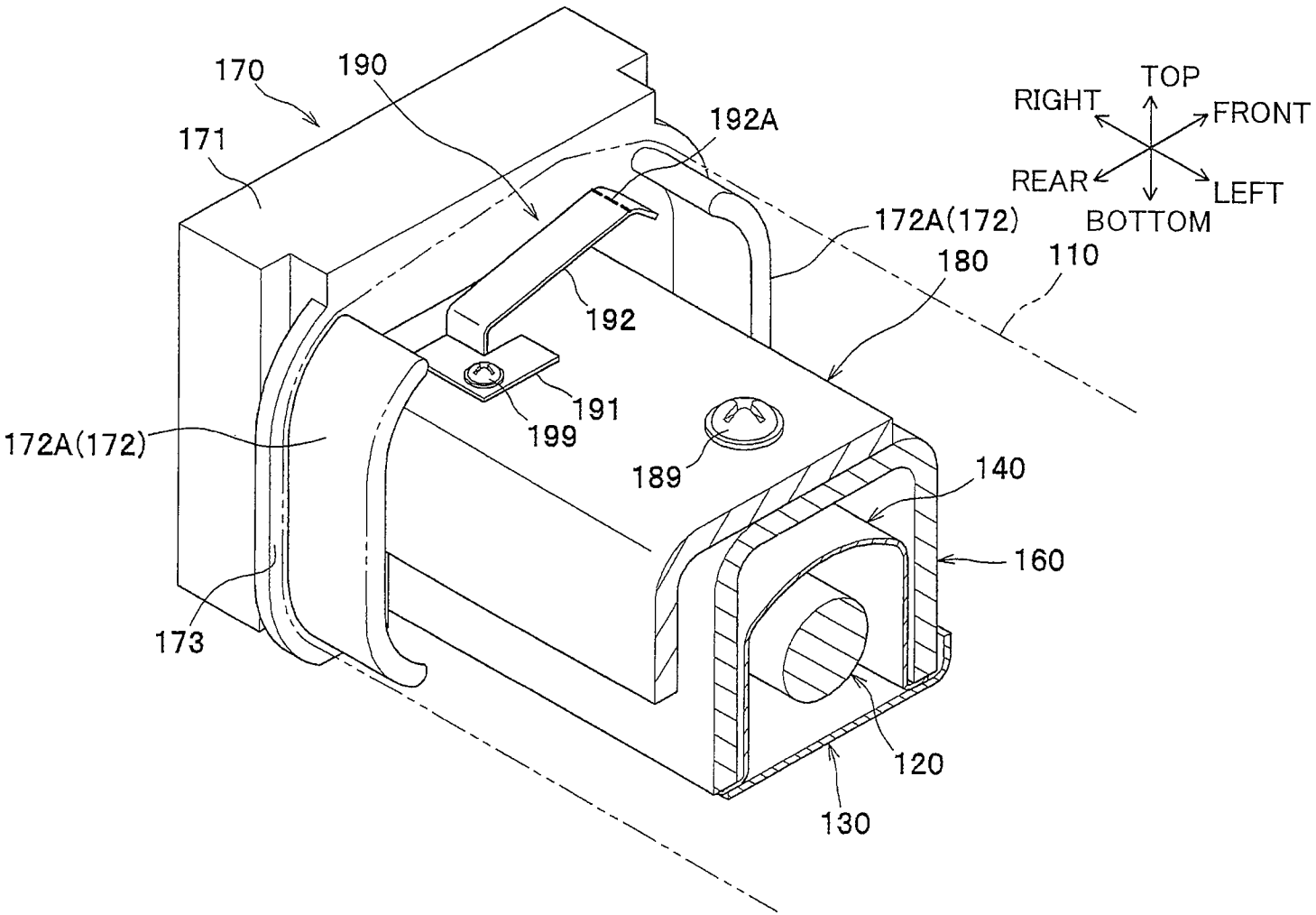
FIG. 3 is an enlarged perspective view showing a periphery of a leaf spring portion.

The guide members 170 are made from a thermally insulation material such as resin. Each of the guide members 170 is disposed at each of the widthwise end portions of the fusing film 110 for guiding circular movement of the fusing film 110. More specifically, each of the guide members 170 is provided to restrain movement of the fusing film 110 in the rightward/leftward direction. As shown in FIG. 3, the guide member 170 includes a supporting portion 171, a guide portion 172, and a restricting portion 173.

The supporting portions 171 support directly or indirectly both widthwise end portions of the halogen lamp 120, the nip plate 130, the reflection plate 140, the stay 160, and the attaching member 180. Since a well known configuration can be employed as a detail configuration for supporting the stay 160 or the like, the explanation of the detail configuration is omitted in this description.

The guide portion 172 includes a pair of walls each protruding inward from an inner surface of the supporting portion 171 in the rightward/leftward direction. Each guide portion 172 has a generally arc shape in cross-section. The guide portion 172 is inserted into the tubular fusing film 110. That is, each guide portion 172 has the guide surface 172A that is an outer surface in a radial direction of the fusing film 110 and that is in sliding contact with the inner peripheral surface of the fusing film 110 so as to guide the circular movement of the fusing film 110.

Each restricting surface 173 comes in contact with the end surface of the fusing film 110 when the fusing film 110 moves left or light by the circular movement thereof. Thus, the restricting surface 173 restricts widthwise movement of the fusing film 110.

Figure 4:
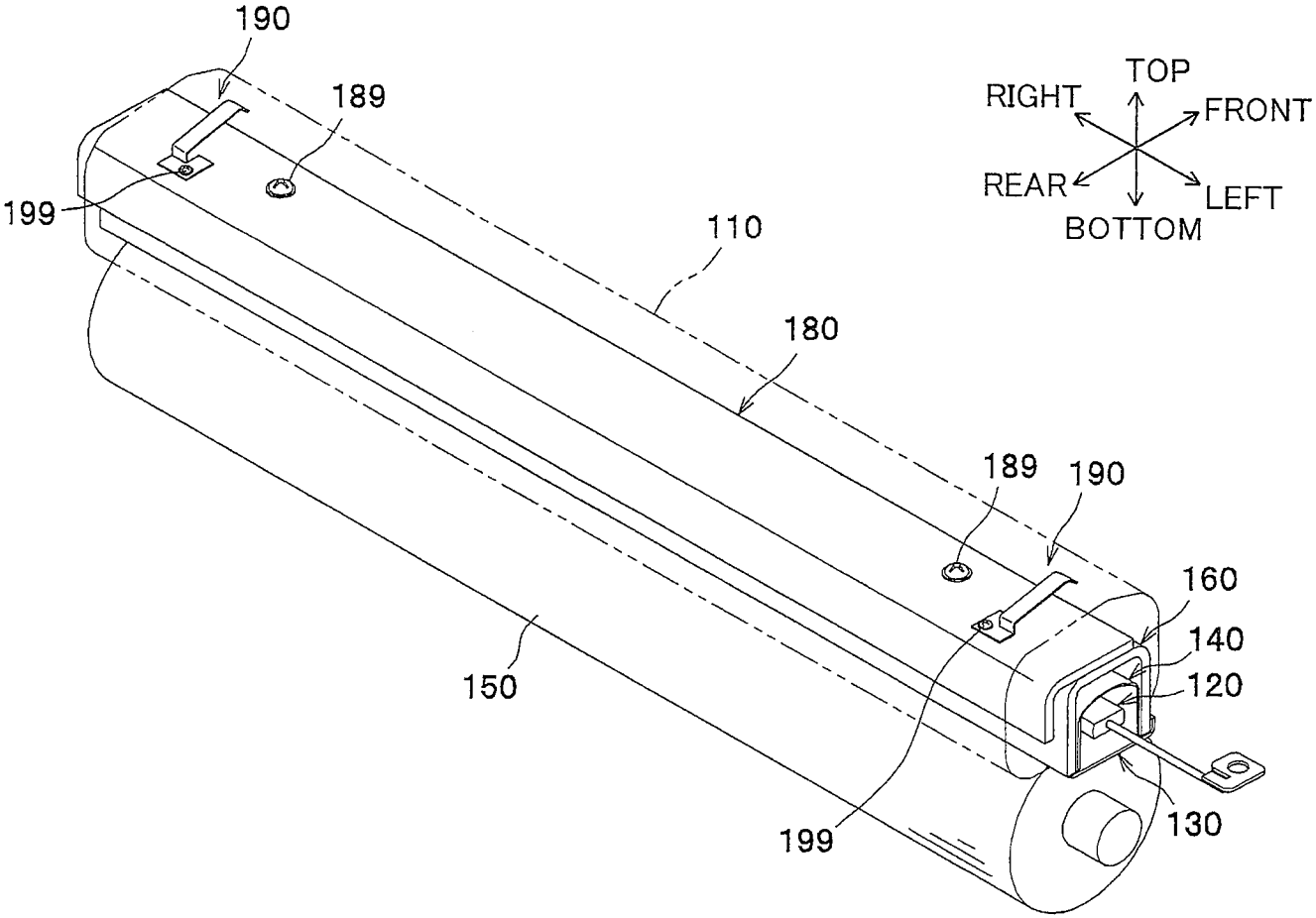
FIG. 4 is a perspective view showing the fixing device omitting guide members.

The attaching member 180 is adapted to attach the leaf spring members 190 and is located along the stay 160. More specifically, the attaching member 180 has a generally L-shape in cross-section and extends from one end of the fusing film 110 to the other end thereof in the widthwise direction (an axial direction of the fusing film 110) as shown in FIG. 4. The attaching member 180 is made from a material such as heat resistant resin or steel plate.

Only the single attaching member 180 is provided on the fixing device 100 and fixed to an upper surface of the stay 160 by a screw 189. Specifically, each widthwise end portion of the attaching member 180 is fixed to the stay 160 having high rigidity. In other words, a center portion in the widthwise direction of the attaching member 180 is not fixed to the stay 160.

As shown in FIG. 3, the leaf spring members 190 are adapted for restricting a slack of the fusing film 110 by urging the inner peripheral surface of the fusing film 110 toward radially outward of the fusing film 110. That is, the leaf spring member 190 prevents the fusing film 110 from deforming radially inward. The leaf spring member 190 is fabricated by bending a steel plate, stainless plate, and the like, and has a base portion 191 and an arm portion 192.

As shown in FIGS. 2 and 3, the arm portion 192 extends upward from the base portion 191 and further extends in a circumferential direction of the fusing film 110 (a circular movement direction of the fusing film 110). An end of the arm portion 192 is configured to move freely in the vertical direction. The arm portion 192 has an end portion 192A positioned downstream in the circular movement direction of the fusing film 110 and is configured to resiliently deform downward when the end portion 192A comes in contact with the inner peripheral surface of the fusing film 110. When the arm portion 192 is resiliently deformed, a reaction force is generated on the arm portion 192. Hence, this reaction force of the arm portion 192 urges the inner peripheral surface of the fusing film 110 outward in the radial direction of the fusing film 110. The end portion 192A is in sliding contact with the inner peripheral surface of the fusing film 110 when the fusing film 110 circularly moves.

The end portion 192A has a surface that is in sliding contact with the inner peripheral surface of the fusing film 110 and is bent into a curved shape in cross-section. More specifically, the end portion 192A has a curvature greater than that of the fusing film 110. Hence, a contact state between the end portion 192A and the inner peripheral surface of the fusing film 110 is closer to line contact than surface contact (see the bold dash line in FIG. 3). Therefore, a contact area between the arm portion 192 and the inner peripheral surface of the fusing film 110 can be reduced.

As shown in FIG. 4, the pair of the leaf spring member 190 is provided the inner side of the both widthwise ends of the fusing film 110. Each base portion 191 is attached to an upper surface of the attaching member 180 by a screw 199 such that each leaf spring member 190 is disposed inside the fusing film 110. More specifically, each leaf spring member 190 is attached to a portion where the attaching member 180 is fixed to the stay 160, that is, a position adjacent to the screw 189 and outside of the screw 189 in the rightward/leftward direction.

As shown in FIG. 3, the arm portion 192 of each leaf spring member 190 is located on a position (same position) overlapping with the guide surface 172A of the guide member 170 in the rightward/leftward direction (the axial direction of the fusing film 110). Therefore, the arm portion 192 can apply a tensile force to the inner peripheral surface of the fusing film 110 with stability in comparison with a case that the leaf spring members 190 are provided inner side of the guide surfaces 172A in the rightward/leftward direction.

The laser printer 1 according to the above-described embodiment provides the following advantages and effects. The leaf spring member 190 is disposed so as to be in sliding contact with the inner peripheral surface of the fusing film 110. Hence, the leaf spring member 190 urges the inner peripheral surface of the fusing film 110 outward in the radial direction of the fusing film 110. Therefore, the urging force of the lead spring members 190 can be transmitted to the fusing film 110 with accuracy, and thus, the tensile force can be applied to the fusing film 100 with stability.

The leaf spring member 190 can be fabricated as a single part by bending a single metal sheet such as plated sheet steel, stainless plate, and the like. Hence, the number of parts can be reduced in comparison with a conventional fixing device having a structure that a movable wall provided on a flange is urged by a spring.

Further, since the end portion 192A has a curvature greater than that of the fusing film 110, the leaf spring member 190 is in line contact with the fusing film 110. Therefore, a contact area between the arm portion 192 and the inner peripheral surface of the fusing film 110 can be reduced in comparison with a conventional fixing device having a structure that a movable wall having a circular arc shaped outer surface is in surface contact with an inner peripheral surface of a film.

Accordingly, increment of rotational torque of the fusing film 110 can be restrained and the fusing film 100 can be circularly moved with stability.

The leaf spring members 192 are positioned at both widthwise end portions of the fusing film 110 so that the arm portion 192 of each leaf spring member 190 is located on a position overlapping with the guide surface 172A of the guide member 170 in the rightward/leftward direction. Therefore, the arm portion 192 can provide a tensile force to the inner peripheral surface of the fusing film 110 with stability and in a balanced manner. As a result, the fusing film 100 can be circularly moved with stability.

Two leaf spring members 190 are provided and fixed to the single attaching member 180. In other words, two leaf spring members 190 are fixed to an identical member. Hence, each of the leaf spring members 190 can provide the tensile force having substantially same strength to the inner peripheral surface of the fusing film 110. Therefore, the arm portions 192 can provide tensile forces to the inner peripheral surface of the fusing film 110 in a balance manner in comparison with a conventional fixing device having a structure that two movable walls are provided on the both end portions of a flange, respectively. As a result, the fusing film 100 can be circularly moved with stability.

Since the attaching member 180 to which the leaf spring members 190 are attached is fixed to the stay 160 having high rigidity, the leaf spring members 190 can be fixed with stability. Therefore, the urging force of the lead spring members 190 can be transmitted to the fusing film 110 with accuracy, and thus, the tensile force can be applied to the fusing film 100 with stability.

Since each leaf spring member 190 is attached to a portion where the attaching member 180 is fixed to the stay 160, that is, a position adjacent to the screw 189, stability of the leaf spring members 190 can be improved. Therefore, the urging force of the lead spring members 190 can be transmitted to the fusing film 110 with accuracy, and thus, the tensile force can be applied to the fusing film 100 with stability.

While the invention has been described in detail with reference to specific embodiments thereof, it would be apparent to those skilled in the art that many modifications and variations may be made therein without departing from the spirit of the invention, the scope of which is defined by the attached claims.

In the above-described embodiment, each leaf spring member 190 is attached to a position adjacent to the screw 189 and outside of the screw 189 in the rightward/leftward direction (a portion where the attaching member 180 is fixed to the stay 160). However, each leaf spring member 190 may be attached to a position adjacent to the screw 189 and inside of the screw 189 in the rightward/leftward direction. Note that, in the above-described embodiment, each leaf spring member 190 is attached to the attaching member 180 by the screw 199. However, attaching method of the leaf spring member is not limited to the screw.

In the above-described embodiment, the attaching member 180 is fixed on the stay 160. However, an attaching member may by fixed on the guide members 170 (the supporting portions 171). Note that, it is preferable that an attaching member is fixed on a high rigid member to fix a leaf spring member with stability. Further, although the above-described embodiment has no particular explanation for an attaching member, the attaching member may be a member that is made by assembling multiple components.

In the above-described embodiment, the attaching member 180 that is a different member from the stay 160 is employed as an attaching member to which the leaf spring members 190 are attached. However, the stay 160 may be employed as the attaching member to which the leaf spring members 190 are attached.

In the above-described embodiment, the arm portion 192 of each leaf spring member 190 is located on a position overlapping with the guide surface 172A of the guide portion 172 in the rightward/leftward direction (an axial direction of the tubular member). The arm portion 192 of each leaf spring member 190 may be located on a position inside of the guide surface 172A (the guide portion 172) in the rightward/leftward direction. That is, an arm portion may not be overlapped with a guide surface in the axial direction of the tubular member.

In the above-described embodiment, the curved shape of the end portion 192A of the arm portion 192 is formed by bending the end portion 192A (a surface in sliding contact with an inner surface of a tubular member). The curved shape is formed by grinding the surface of the arm portion that is in sliding contact with the inner surface of the tubular member.

In the above-described embodiment, two leaf spring members 190 are provided. The number of the leaf spring member is not limited to two leaf spring members. For example, single leaf spring member may be provided, or three leaf spring members may be provided. If three leaf spring members are provided on the attaching member 180, third leaf spring member 190 may be provided on a position corresponding to a center portion of the fusing film 110 in the rightward/leftward direction. Further, if single leaf spring member is provided on the attaching member 180 instead of two leaf spring members 190, the single leaf spring member extends in the rightward/leftward direction. Note that, it is preferable that the leaf spring member is symmetrically provided in the axial direction of the tubular member on the basis of center portion of the tubular member in the axial direction thereof in order to provide the tensile force to the inner peripheral surface of the tubular member in a balance manner.

The configuration of the leaf spring member 190 is just one example and is not limited to the above-described embodiment. That is, the specific configuration of the leaf spring member may be changed if a changed leaf spring member has functions and effects equivalent to the leaf spring member 190 in the above-described embodiment. For example, the leaf spring member may be formed by bending an elongated metal plate at an acute angle in cross-section.

The configuration of the guide member 170 is just one example and is not limited to the above-described embodiment. That is, the specific configuration of the guide member may be changed if a changed guide member can guide circular movement of the tubular member. For example, the guide member may have flange shape.

In the above-described embodiment, the reflection plate 140 and the stay 160 are provided on the fixing device 100. However, only the stay may be provided (the reflection plate is not provided), and the reflection plate and the stay may not be provided. If the reflection plate 140 is not provided, a reflection surface is formed on an inner surface of the stay 160.

In the above-described embodiment, the pressure roller 150 is employed as a backup member. However, the backup member may be a belt-like pressure member.

In the above-described embodiment, the halogen lamp 120 (halogen heater) is employed as a heat generator. However, the heat generator may be an infrared heater and a carbon heater.

In the above-described embodiment, the nip plate 130 is employed as a nip member. However, the nip member may not be a plate shape. Further, in the above-described embodiment, the nip plate 130 receives the radiant heat from the halogen lamp 120 and transmits the radiant heat to the fusing film 110 (the tubular member). For example, the nip member may be a plate-likes ceramic heater that is disposed in sliding contact with the inner peripheral surface of the tubular member, generates and transmits heat to the tubular member.

In the above-described embodiment, plain paper and a postcard are employed as the sheet P. However, an OHP sheet is available.

In the above-described embodiment, the image forming device is the monochromatic laser printer. However, a color laser printer, an LED printer, a copying machine, and a multifunction device are also available.

What is claimed is:

1. A fixing device comprising:

a flexible tubular member that is circularly movable in a moving direction, has an inner peripheral surface and has end portions in an axial direction;

a nip member disposed so as to be in sliding contact with the inner surface of the tubular member;

a backup member configured to provide a nip region in cooperation with the nip member upon nipping the tubular member between the backup member and the nip member;

a stay that is located inside the tubular member and supports the nip member, the stay being configured to receive a load from the backup member;

an attaching member that is located inside the tubular member and extends from one end portion to another end portion in the axial direction, the attaching member being fixed to the stay; and a leaf spring member that is disposed so as to be in sliding contact with the inner peripheral surface of the tubular member and is configured to urge the inner peripheral surface of the tubular member outward in a radial direction of the tubular member, the leaf spring member including at least two leaf spring members that are attached to the attaching member.

2. The fixing device according to claim 1, wherein the leaf spring member has a surface that is in sliding contact with the inner peripheral surface of the tubular member and has a curved shape.

3. The fixing device according to claim 2, wherein the surface of the leaf spring member has a curvature greater than that of the tubular member.

4. The fixing device according to claim 1, wherein the tubular member has end portions in an axial direction, and further comprising a pair of guide members each of which is located on corresponding one of the end portions, each of the pair of guide members having a guide surface that is configured to be in sliding contact with the inner peripheral surface of the tubular member to guide a circular movement of the tubular member, and wherein the leaf spring member comprises a pair of leaf spring members each of which is positioned on corresponding one of the end portions, each of the pair of leaf spring members including an arm portion that extends in a circumferential direction of the tubular member and has an end portion positioned downstream in the moving direction, the end portion of the arm portion being configured to be in sliding contact with the inner peripheral surface of the tubular member, and wherein each of the leaf spring members is disposed such that the arm portion is positioned adjacent to the corresponding one of the guide members in the axial direction of the tubular member.

5. A fixing device comprising:

a flexible tubular member that is circularly movable in a moving direction, has an inner peripheral surface and has end portions in an axial direction;

a nip member disposed so as to be in sliding contact with the inner surface of the tubular member;

a backup member configured to provide a nip region in cooperation with the nip member upon nipping the tubular member between the backup member and the nip member;

a stay that is located inside the tubular member and supports the nip member, thereby being configured to receive a load from the backup member;

an attaching member that is located inside the tubular member and extends from one end portion to another end portion in the axial direction; and a leaf spring member that is disposed so as to be in sliding contact with the inner peripheral surface of the tubular member and is configured to urge the inner peripheral surface of the tubular member outward in a radial direction of the tubular member, the leaf spring member including at least two leaf spring members that are attached to the attaching member, wherein the attaching member has end portions in the axial direction, the end portions of the attaching member being fixed to the stay, and wherein each of the leaf spring members is attached to the attaching member at corresponding one of positions each of which is adjacent to corresponding one of portions where each end portion of the attaching member is fixed to the stay, respectively.

6. The fixing device according to claim 5, wherein the leaf spring member has a surface that is in sliding contact with the inner peripheral surface of the tubular member and has a curved shape.

7. The fixing device according to claim 6, wherein the surface of the leaf spring member has a curvature greater than that of the tubular member.

8. The fixing device according to claim 5, wherein the tubular member has end portions in an axial direction, and further comprising a pair of guide members each of which is located on corresponding one of the end portions, each of the pair of guide members having a guide surface that is configured to be in sliding contact with the inner peripheral surface of the tubular member to guide a circular movement of the tubular member, and wherein the leaf spring member comprises a pair of leaf spring members each of which is positioned on corresponding one of the end portions, each of the pair of leaf spring members including an arm portion that extends in a circumferential direction of the tubular member and has an end portion positioned downstream in the moving direction, the end portion of the arm portion being configured to be in sliding contact with the inner peripheral surface of the tubular member, and wherein each of the leaf spring members is disposed such that the arm portion is positioned adjacent to the corresponding one of the guide members in the axial direction of the tubular member.

* * * * *